US012472444B2

(12) United States Patent
Kessler et al.

(10) Patent No.: US 12,472,444 B2
(45) Date of Patent: Nov. 18, 2025

(54) BISTABLE PIVOT HINGE

(71) Applicant: LoveFrom, Inc., San Francisco, CA (US)

(72) Inventors: Patrick Kessler, San Francisco, CA (US); Jeremy Bataillou, San Francisco, CA (US); Benoit Louzaouen, San Francisco, CA (US)

(73) Assignee: LoveFrom, Inc., San Francisco, CA (US)

( * ) Notice: Subject to any disclaimer, the term of this patent is extended or adjusted under 35 U.S.C. 154(b) by 77 days.

(21) Appl. No.: 18/537,624

(22) Filed: Dec. 12, 2023

(65) Prior Publication Data

US 2024/0189730 A1 Jun. 13, 2024

Related U.S. Application Data

(60) Provisional application No. 63/432,353, filed on Dec. 13, 2022.

(51) Int. Cl.
*A63H 33/00* (2006.01)

(52) U.S. Cl.
CPC ..... *A63H 33/003* (2013.01)

(58) Field of Classification Search
CPC ..... A63H 33/003; A63H 33/16; A63H 33/22
USPC ..... 446/487; 428/12, 181, 36.9; 416/70 A
See application file for complete search history.

(56) References Cited

U.S. PATENT DOCUMENTS 2,974,434 A * 3/1961 Gibson ..... B42D 15/04 428/116
3,046,684 A * 7/1962 Tritt ..... A63H 33/00 428/116
3,228,138 A * 1/1966 Lohnes ..... B42D 15/04 D19/7
3,461,023 A * 8/1969 Pacza ..... G09F 19/10 446/88
4,673,373 A 6/1987 Herring et al.
7,347,670 B1 * 3/2008 Henderson ..... A45B 27/02 416/70 A
2007/0218801 A1 9/2007 Weinshanker
(Continued)

OTHER PUBLICATIONS

International Search Report and Written Opinion issued Jun. 13, 2024 in corresponding PCT Application PCT/US2023/083678, filed Dec. 12, 2023.

*Primary Examiner* — Joshua D Huson
(74) *Attorney, Agent, or Firm* — Brownstein Hyatt Farber Schreck, LLP

(57) ABSTRACT

Embodiments described herein take the form of a bistable hinge. The bistable hinge typically includes an elastic element and a pair of rigid structures. Each rigid structure in the illustrated embodiment includes a pair of pivot cylinders connected to a rotating surface, as well as a detent formed on a portion of the rotating surface. The elastic element is retained by the detent, such that the spring force of the elastic element, when stretched, is transmitted to the rigid structure. The rigid structure may incorporate any suitable protrusions, retainers, or the like around which the elastic element extends in lieu of the illustrated detents. As the elastic element is stretched during operation of the hinge, the elastic element maintains contact with the detents. Further, as the hinge transitions from a closed state to an open state, the detents stretch the elastic element, thereby applying tension to it.

5 Claims, 6 Drawing Sheets

(56) References Cited

U.S. PATENT DOCUMENTS

| | | | | |
|---|---|---|---|---|
| 2009/0078838 | A1* | 3/2009 | Chang | A45B 3/00 108/41 |
| 2009/0311447 | A1* | 12/2009 | Gold | A47G 27/0206 428/12 |
| 2021/0220751 | A1 | 7/2021 | Yamada et al. | |

* cited by examiner

BISTABLE PIVOT HINGE

CROSS-REFERENCE TO RELATED APPLICATION

This application is a nonprovisional patent application of and claims the benefit under 35 U.S.C. § 119(e) of U.S. Provisional Patent Application No. 63/432,353, filed Dec. 13, 2022, and titled "BISTABLE PIVOT HINGE", the contents of which are incorporated herein by reference in its entirety.

FIELD

The described embodiments relate generally to a bistable hinge. More particularly, the present embodiments relate to a hinge that may be incorporated into a mechanism transitioning between an open and closed state, where the hinge is biased towards the open or closed state depending on a position of the hinge.

BACKGROUND

Many structures and devices utilize a hinge to open or close. Typical hinges, when balanced, are no more stable in any one position than another. That is, hinges may permit a structure to rotate but typically do not bias a rotating structure towards an open or closed position. Certain structures or devices, however, may be more useful or operate more efficiently when in an open or closed position. Put another way, certain structures incorporating a hinge may be more useful when the structures are open or closed rather than in an intermediate position.

SUMMARY

One embodiment described herein takes the form of a toy, comprising: an expandable body; a first rotating surface attached to a first portion of the expandable body; a second rotating surface attached to a second portion of the expandable body; a first detent attached to the first rotating surface; a second detent attached to the second rotating surface; a bistable hinge, comprising: an elastic element attached to the first rotating surface and the second rotating surface; and a pivot structure attached to the first and second rotating surfaces; wherein: as the first and second rotating surfaces rotate, a tension in the elastic element changes.

A second embodiment described herein takes the form of a bistable hinge, comprising: an elastic element; a first rotating surface attached to the elastic element; a second rotating surface attached to the elastic element; a first detent attaching the first rotating surface to the elastic element; and a second detent attaching the first rotating surface to the elastic element; wherein: the elastic element biases the first and second rotating surfaces to a first position when the elastic element is on a first side of a pivot plane; and the elastic element biases the first and second rotating surfaces to a second position when the elastic element is on a second side of the pivot plane.

Yet another embodiment described herein takes the form of a pivot structure, comprising: a first pivot cylinder; a second pivot cylinder abutting the first pivot cylinder; a first securement strip passing between the first and second pivot cylinders and attached to the first pivot cylinder; and a second securement strip passing between the first and second pivot cylinders and attached to the second pivot cylinder; wherein: the first and second pivot cylinders revolve about a pivot axis defined along abutting surfaces of the first and second pivot cylinders.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

Embodiments described herein generally take the form of a hinge or hinged item that exhibits bi-stability. That is, the hinge is in equilibrium when it is open or closed and reverts to an open or closed state in the absence of external forces. The terms "open" and "closed," as used herein, refer to two different positions of the hinge and do not necessarily require that the hinge be fully open or fully closed.

The bistable hinge typically includes an elastic element and a pair of rigid structures. Each rigid structure in the illustrated embodiment includes a pair of pivot cylinders connected to a rotating surface, as well as a detent formed on a portion of the rotating surface. The elastic element is attached to or retained by the detent, such that the spring force of the elastic element, when stretched, is transmitted to the rigid structure. The rigid structure may incorporate any suitable protrusions, retainers, or the like around which the elastic element extends in lieu of the illustrated detents. As the elastic element is stretched during operation of the hinge, the elastic element maintains contact with the detents. Further, as the hinge transitions from a closed state to an open state (or, in some cases, a partially-open state), the detents stretch the elastic element, thereby applying tension to it.

When the bistable hinge is in a fully-extended position, the elastic element is stretched to its operational maximum (e.g., it is stretched further than at any other point during the motion and/or operation of the hinge), although not to its elastic limit. When so stretched, the internal spring force of the elastic element resulting from placing it in tension attempts to contract the elastic element. In the absence of any countervailing force, the elastic element will contract, returning to its rest state. This contraction by the elastic element transmits force through the retainers to the rigid structure (the "operating force"), causing the rigid structure to pivot about its pivot axis and so either open or close. As the rigid structure reaches its open or closed state, the internal tension of the elastic element is reduced, likewise reducing the operating force of the rigid structure. The rigid structure's pivot may be stopped by portions of the rigid structure contacting one another or by a feature attached to the rigid structure contacting itself or another structure (e.g., a stop).

Figure 1:
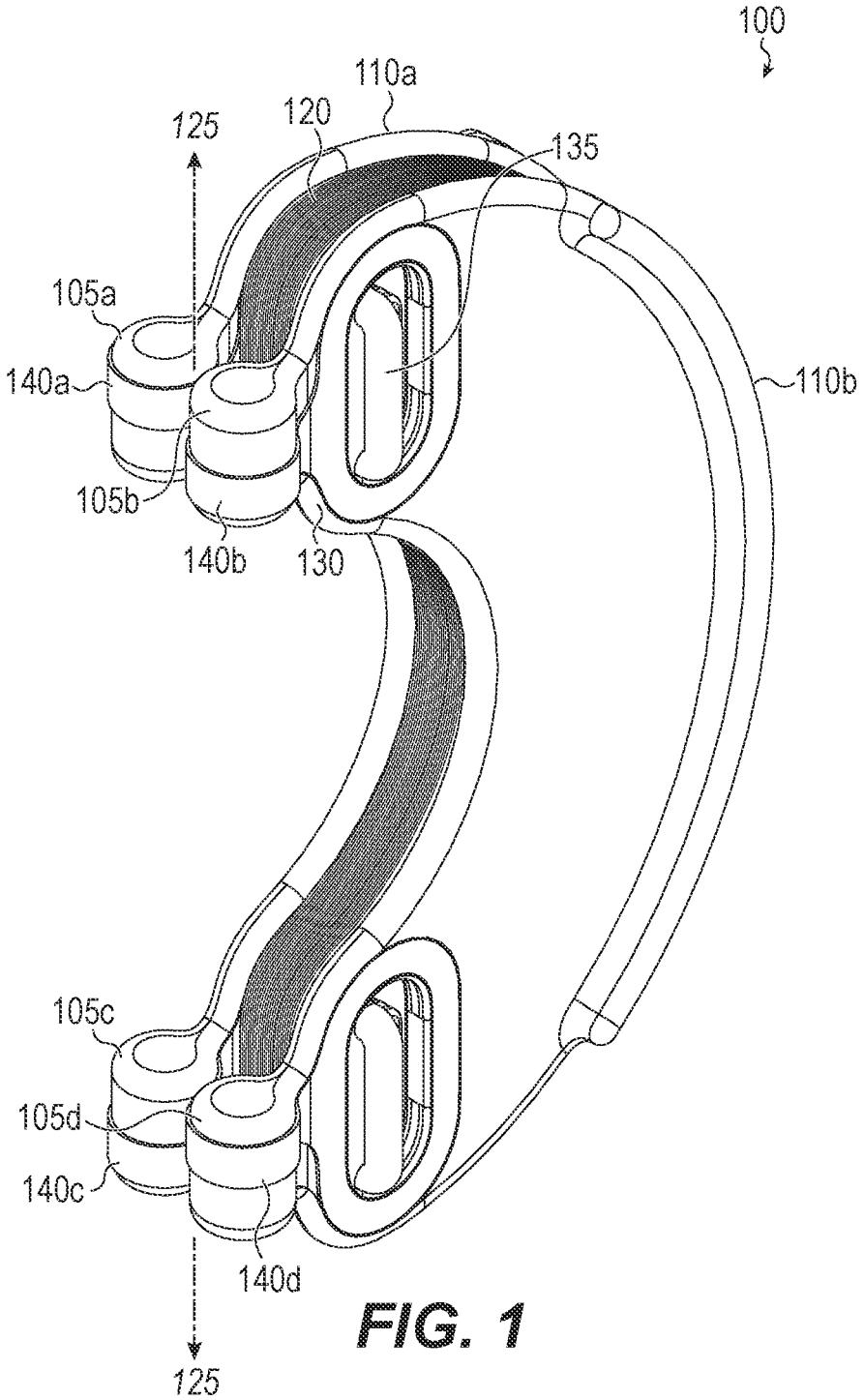
FIG. 1 shows a structure that utilizes a bistable hinge, in a closed position.

FIG. 1 illustrates a sample embodiment of a bistable hinge (or simply "hinge"), here incorporated into an expandable toy nose 100. The toy nose shown in FIG. 1 includes a hinge defined by two pairs of opposing pivot cylinders (105*a* and 105*b*, as well as 105*c* and 105*d*) and associated rotating surfaces 110*a*, 110*b*, and an expandable body 120 extending between the rotating surfaces. Generally, as the pivot cylinders 105*a-d* rotate, the rotating surfaces 110*a-b* move from the closed position shown in FIG. 1, to the partially-open position shown in FIGS. 2-4, and finally to the open position shown in FIG. 5. The "open position" of the toy nose structure 100 is thus one in which the expandable body 120 is fully expanded and the rotating surfaces 110*a-b* contact one another. Securement strips 140*a*, 140*b*, 140*c*, 140*d* attach the rotating surfaces 110*a*, 110*b* to one another and permit rotation but not lateral movement, as discussed herein. It should be noted that the embodiment shown in FIG. 1 utilizes four securement strips, two for each pair of pivot cylinders. More or fewer securement strips 140*a*-140*d* may be used in different embodiments. Each securement strip encircles an aperture in which a detent 135, as described below, is positioned. Further, each securement strip 140*a*-140*d* encircles one aperture on a first face of a first rotating surface 110*a* and a second aperture on an opposing face of a second rotating surface 110*b*. Securement strips, their function, and operation are described below in more detail with respect to FIG. 6; the securement strips of FIG. 1 function as do those of FIG. 6.

Figure 2:
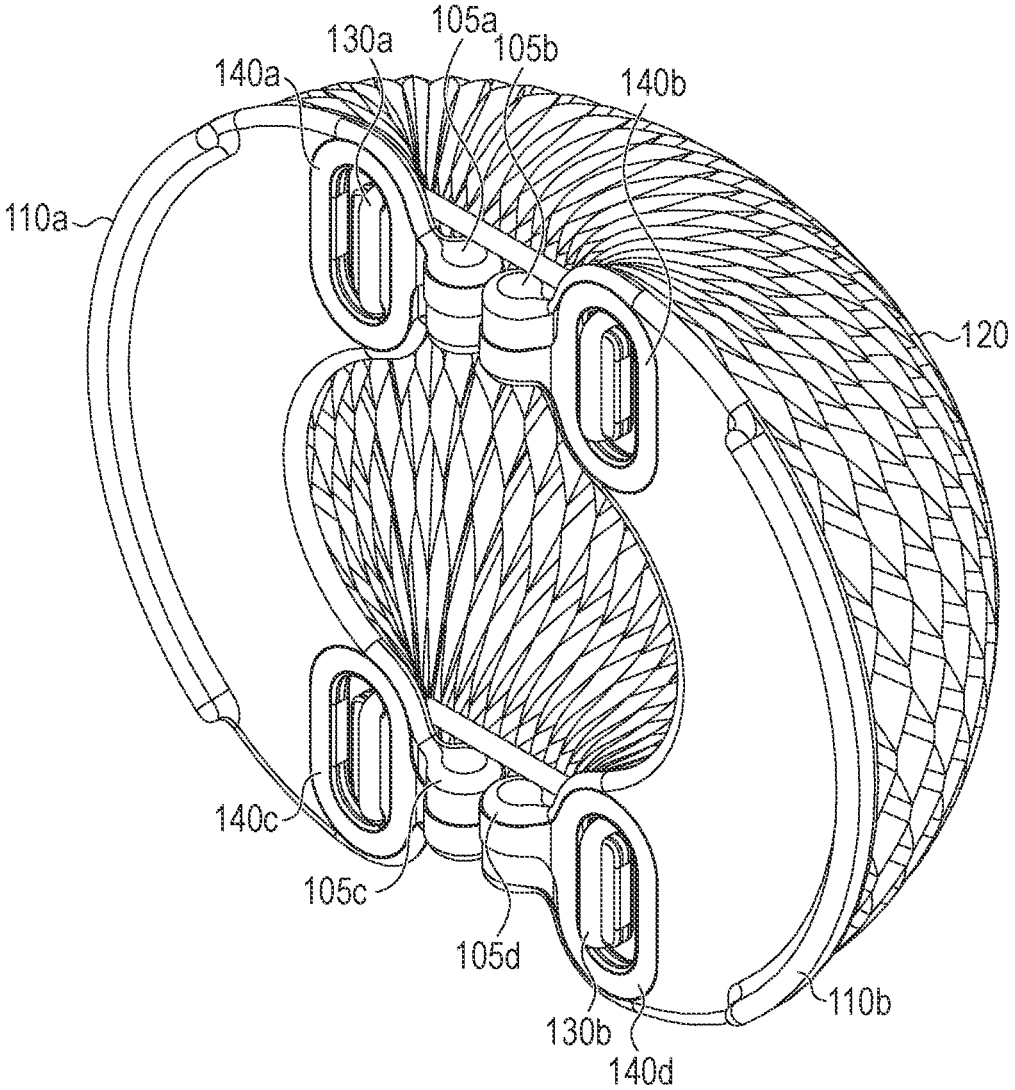
FIG. 2 shows the structure of FIG. 1 in a partially-open position, illustrating the bistable hinge at maximum expansion.
Figure 3:
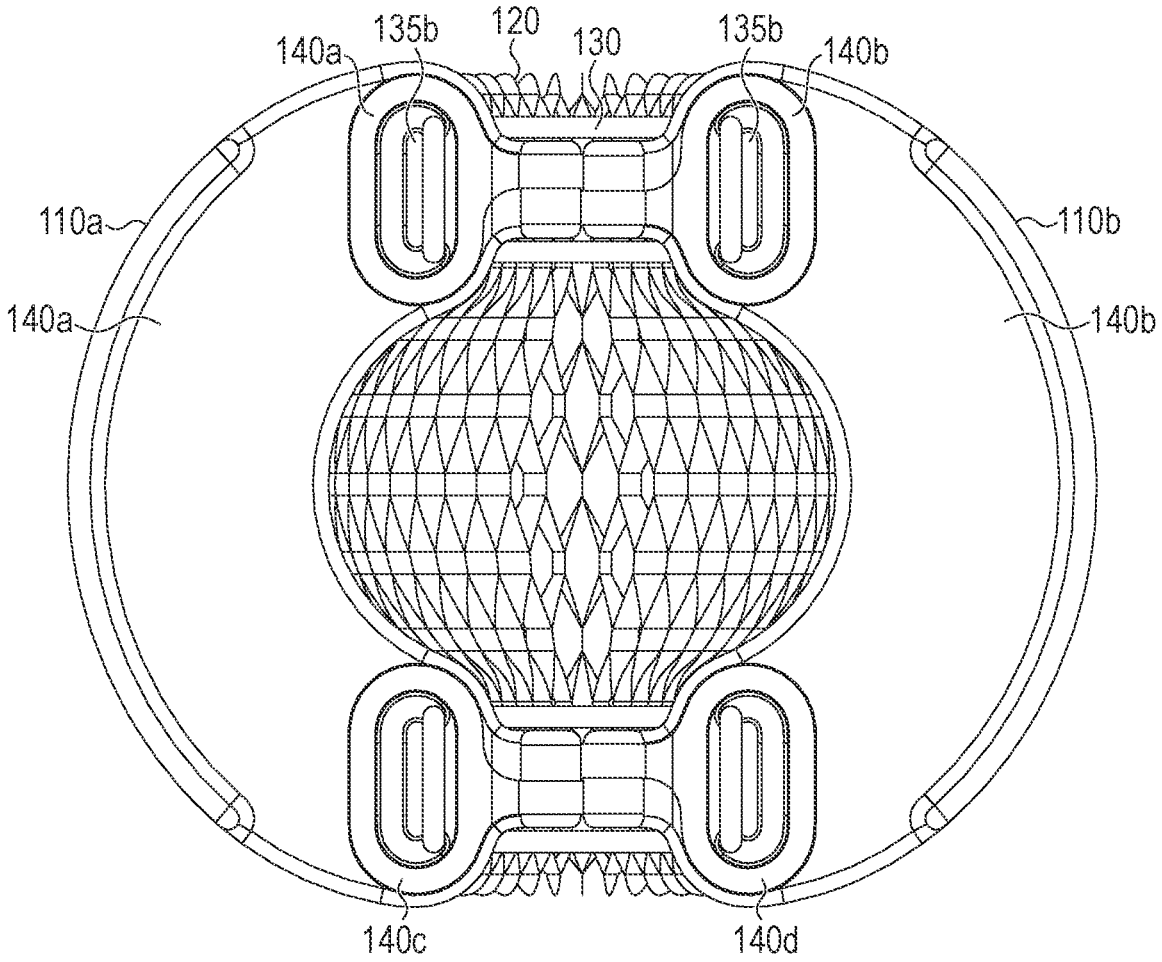
FIG. 3 is a second view of the structure of FIGS. 1 and 2 in a partially-open position.
Figure 4:
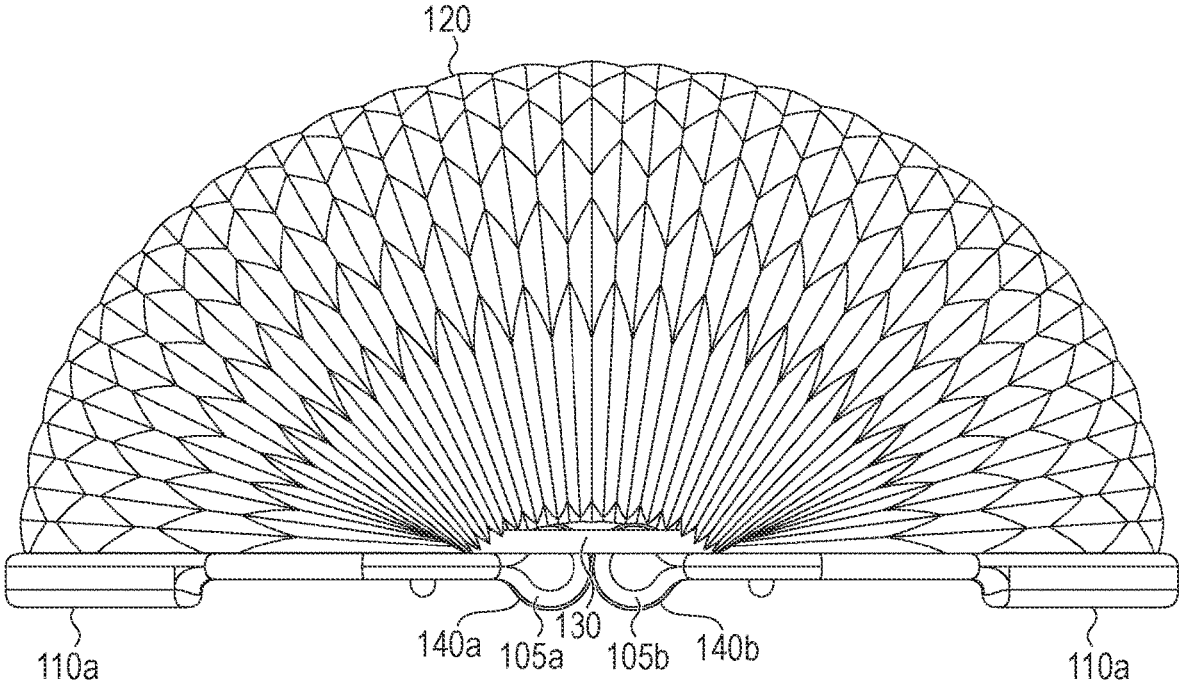
FIG. 4 is a top view of the structure of FIGS. 1-3 in a partially-open position.
Figure 5:
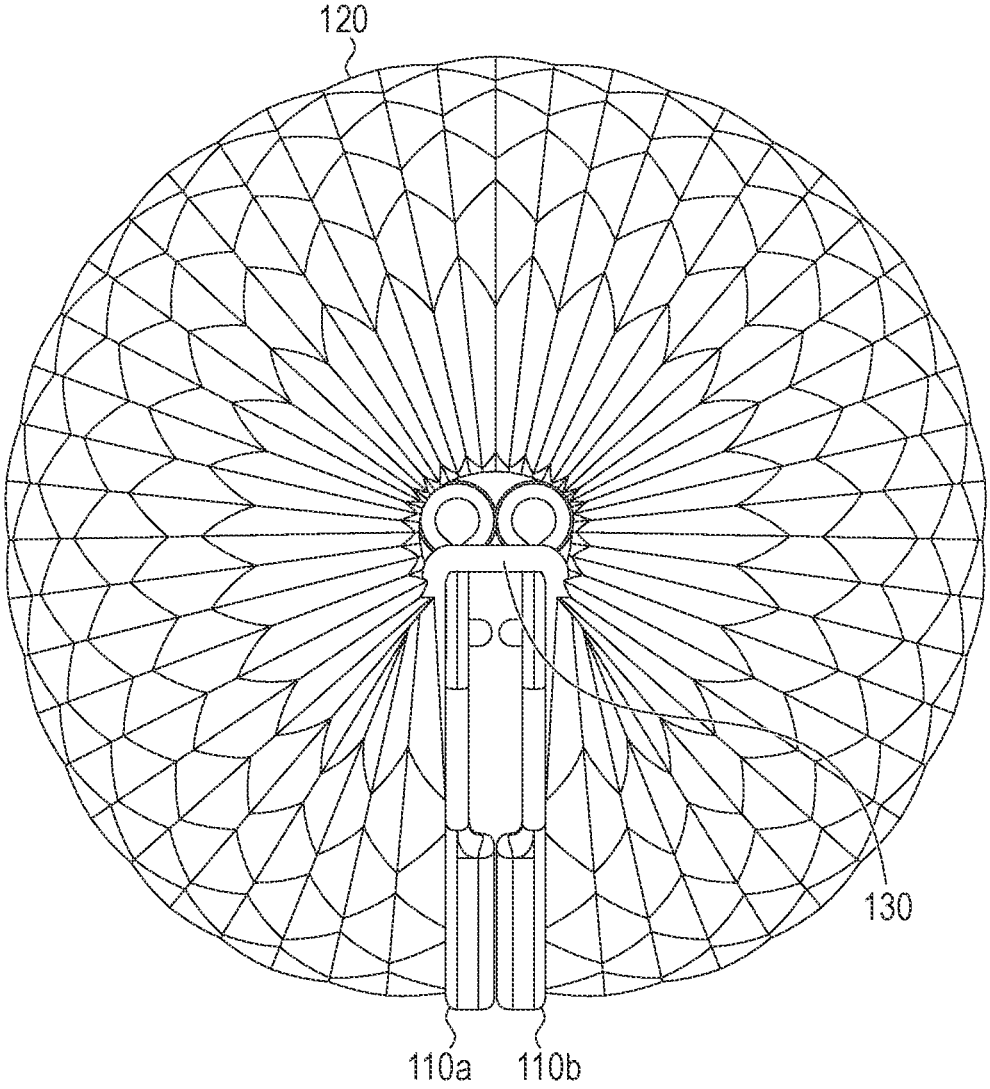
FIG. 5 is a top view of the structure of FIGS. 1-4 in a fully-open position, illustrating that the rotating surfaces are in contact with one another when the bistable hinge is fully open.

As shown in FIGS. 1-5, the bistable hinge transitions between various states as the toy nose goes from its closed position to its open position. The hinge moves rotationally but not laterally as it opens and closes. Further, the hinge rotates about a pivot axis 125 defined along a line intersecting contact surfaces of the pivot cylinders 105*a-d* (e.g., the point at which opposing pivot cylinders 105*a*-105*b* and 105*c*-105*d* contact one another). FIG. 1 shows the bistable hinge and toy nose in a closed state, FIG. 2 shows the bistable hinge and toy nose in a partially-open state, FIG. 3 is another view of the bistable hinge and toy nose in the partially-open state, FIG. 4 is yet another view of the bistable hinge and toy nose in the partially-open state, and FIG. 5 shows the bistable hinge and toy nose in an open state.

Generally, an elastic element(s) 130*a-b* loops around detents 135 of each rotating surface as illustrated in FIG. 1. In the embodiment shown in FIGS. 1-5 there are two elastic elements 130*a-b* and four detents 135*a-d*, but some embodiments may use more or fewer elastic elements and/or detents. In some embodiments the detents 135 may be replaced by grooves, depressions, or the like instead of being formed as protrusions. The rotating surface 110*a* rotates in a first direction, such that the expandable body 120 is sandwiched between the semicircular, rotating surfaces 110*a*, 110*b*. The elastic element 130 is sized such that it is in tension while the hinge is closed.

Generally, the rotating surfaces 110*a*, 110*b* pivot around a pivot axis as they open or close. In operation, the hinge has first and second sides (e.g., the combination of a rotating surface 110 and the affixed pivot cylinder(s) 105) that move away from, or toward, one another depending on how open or closed the hinge is at any given moment. For example, during the toy nose's 100 transition from the closed state of FIG. 1 to the partially-open state of FIG. 2, the first and second sides of the hinge move away from one another as they pivot about the pivot axis 125, as shown by the arrows in FIG. 1. Similarly, when the toy nose 100 transitions from the partially-open state of FIGS. 2-4 to the closed state of FIG. 5, the first and second sides of the hinge pivot towards one another as they are at maximum extension when in the partially-open state shown in FIGS. 2-4. The motion of the sides is always rotational about the pivot axis 125.

Tension in the elastic element 130 increases as the hinge opens and the rotating surfaces 110*a*, 110*b* rotate away from one another. The hinge is in its maximally-expanded state when the toy nose 110 is in its partially-open state shown in FIGS. 2-4. That is, the maximally-expanded state occurs when the sides of the bistable hinge are in plane with one another. Typically, although not necessarily, this places the pivot axis 125 in-plane with the rotating surfaces 110*a*, 110*b* of the hinge as well. The hinge then contracts (e.g., the rotating surfaces 110*a*, 110*b* move towards one another) when the toy nose 110 transitions from the partially-open position of FIGS. 2-4 to the fully-open position of FIG. 5, or when transitioning from the partially-open position of FIGS. 2-4 to the closed position of FIG. 1. Put another way, contraction of the hinge occurs whenever the rotating surfaces 110*a*, 110*b* of the hinge move towards one another and expansion of the hinge occurs whenever the rotating surfaces 110*a*, 110*b* of the hinge move away from one another.

Expansion of the bistable hinge increases the tension in the elastic element 130 while contraction of the hinge reduces tension in the elastic element. As the hinge expands, the detents 135 defined on the first rotating surface 110*a* move away from the detents defined on the second rotating surface 110*b*, stretching the elastic element 130 and increasing its internal tension. When the hinge contracts, the first rotating surface's detents 135 move towards the second rotating surface's detents, relaxing the elastic element 130 and decreasing its internal tension.

The elastic element 130 always seeks to reduce tension in the absence of any external force. Accordingly, if free from such external forces, the elastic element will always pull the rotating surfaces 110*a*, 110*b* of the hinge towards one another (e.g., rotate them and the associated pivot cylinders 105 about the pivot axis 125) unless the rotating surfaces are in unstable equilibrium with perfectly balanced tension about the pivot axis, which is generally momentary at best and extremely hard to achieve. Thus, homeostasis of the system typically occurs only when the hinge is fully open or fully closed and the elastic element 130 seeks to return the hinge to this state.

In practical terms, the internal tension of the elastic element 130 attempts to move the elastic element from an extended to a relaxed or contracted state (except when the elastic element is in such a contracted or relaxed state). As the elastic element 130 is looped around the various detents 135 and, in this embodiment, around the sides of the hinge, the effect of this pulling within the elastic element is to pull the rotating surfaces 110*a*, 110*b* of the hinge towards one another, e.g., to cause the hinge to rotate about its pivot axis 125 to move these surfaces closer together.

At any given moment, a majority of the elastic element 130 is on one side or the other of a plane (the "pivot plane") that contains an instantaneous axis of rotation (the "pivot axis" 125). Typically, the pivot plane is coplanar with a force vector resulting from tension in the elastic element 130. Often, but not necessarily, the pivot plane is coplanar with the rotating surfaces 110*a*, 110*b* when the bistable hinge is maximally extended.

As the elastic element 130 seeks to contract, it will attempt to contract in such a way that it pulls the rotating surfaces 110*a*, 110*b* of the hinge towards one another on the side of the pivot plane where the majority of the elastic element lies. Thus, if the majority of the elastic element is on a first side of the pivot plane, the elastic element 130 will pull the hinge to its open position (shown in FIG. 1). If the majority of the elastic element is on a second side of the pivot plane, it will pull the hinge to its closed position (shown in FIG. 5). This likewise pulls the rotating surfaces along with the hinge by forcing the pairs of pivot cylinders 105*a-b*, 105*c-d* to revolve around the pivot axis 125, in turn opening or closing the toy nose and expanding or contracting the expandable body. A pivot cylinder 105*a*, 105*c* contacts its opposing pivot cylinder 105*b*, 105*d* at the pivot axis 125, although the point on the surface of each pivot cylinder that contacts a surface of its opposing cylinder changes as the pivot cylinders revolve.

Thus, the hinge has three equilibrium points, two of which (corresponding to the hinge being fully closed or fully open) are stable and one of which (corresponding to the hinge being in the partially-open state shown in FIG. 2, where the two rotating surfaces 110*a*, 110*b* are coplanar) is unstable.

As the pivot cylinders 105*a-d* revolve, the rotating surfaces 110*a-b* move, and the related bistable hinge opens or closes, the majority of the elastic element 130 passes through the pivot plane because the detents 135 pass through the pivot plane. Compare the elastic element 130 as shown in FIG. 1 to the elastic element as shown in FIG. 5. In FIG. 1, the entirety of the elastic element 130 is on a first side of the pivot plane while in FIG. 5 the entirety of the elastic element is on a second, opposite side of the pivot plane. Thus, when the toy nose and hinge are in the configuration shown in FIG. 1, the elastic element keeps the toy nose closed. Similarly, while the toy nose and hinge are in the configuration shown in FIG. 5, the elastic element keeps the toy nose open.

Contrast this with FIG. 2, in which a majority of the elastic element is on the first side of the pivot plane while a lesser portion of the elastic element is on the second side of the pivot plane. Accordingly, if no force is applied to the hinge or toy nose while it is in the configuration shown in FIG. 2, the elastic element will contract and return the toy nose to the configuration of FIG. 1. By contrast, if the pivot cylinders 105*a-d* continue to revolve (e.g., the rotating surfaces 110*a-b* continue to rotate about the pivot plane 125) as happens when the toy nose 100 transitions from the configuration of FIG. 2 to that of FIG. 5, the majority of the elastic element passes through the pivot plane to the opposing side. At that point, the elastic element will bias the hinge open and so pull the toy nose towards the open position of FIG. 5.

As the hinge stops moving only when it is fully open or fully closed (e.g., contracted), the hinge is bistable. It has two substantially equal rest states—fully open and fully closed—that it seeks to return to at all times.

The toy nose incorporates a unique pivot structure into the bistable hinge in addition to utilizing the elastic element to provide bistability. Generally, the pivot structure may be used in embodiments as part of a hinge with or without the elastic element, and vice versa. There is no requirement that the elastic element and pivot structure both be incorporated into a single hinge and often they are not.

Figure 6:
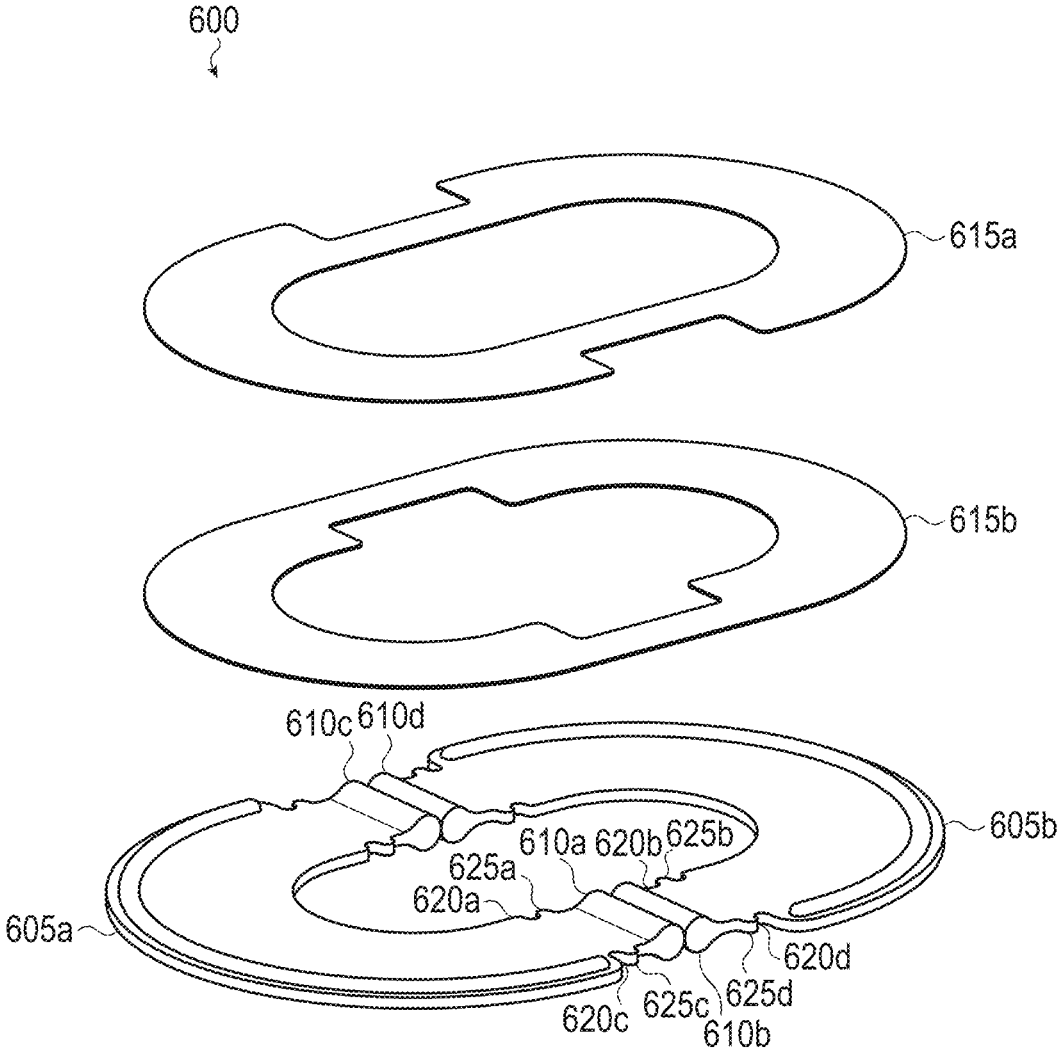
FIG. 6 is an exploded view of another example bistable hinge.

FIG. 6 is an exploded view of a pivot structure 600 suitable for incorporation into a bistable hinge of the toy nose shown in FIGS. 1-5. The pivot structure 600 operates similarly to that of the embodiment shown with respect to those figures, although it differs in some respects such as through the use of differently-shaped securement strips. The pivot structure 600 includes multiple pivot cylinders 610*a*, 610*b*, 610*c*, 610*d* held in place against one another and configured to rotate about a pivot axis while maintaining contact between opposing pivot cylinders. The pivot cylinders may be held against one another by first and second securement strips 615*a*, 615*b*, which likewise attach first and second rotating surfaces 605*a*, 605*b* to one another. The pivot cylinders may be attached to the rotating surfaces or may be formed integrally with the rotating surfaces. In the embodiment shown in the exploded view of FIG. 5, each rotating surface is affixed to, or formed with, a pair of pivot cylinders. For example, first rotating surface 605*a* is affixed to or formed with first and third pivot cylinders 610*a*, 610*c* while second rotating surface 605*b* is affixed to or formed with second and fourth pivot cylinders 610*b*, 610*d*. Certain embodiments may include a rotating surface 605 affixed to or formed with a single pivot cylinder 610, while other embodiments may use three or more pivot cylinders for each rotating surface. Pivot cylinders 610 may extend along an entire edge or side of a rotating surface 605 or may extend along only a portion of a rotating surface.

The securement strip 615*a* attaches to a first side of the first rotating surface 605*a* and its associated pivot cylinders 610*a*, 610*d*. The securement strip 615*a* passes between the first and second pivot cylinders 610*a*, 610*b* and likewise between the second and fourth pivot cylinders 610*c*, 610*d* and attaches to an opposing side of the second rotating surface 605*b*. That is, if the securement strip 615*a* attaches to the "top" surface of the first rotating surface 605*a* (with reference to the orientation shown in FIG. 5) then the securement strip 615*a* likewise attaches to the "bottom" surface of the second rotating surface 605*b*. Likewise, the second securement strip 615*b* attaches to an opposing side of the first rotating surface 605*a* and a first side of the second rotating surface 605*b*, again passing between each pair of adjacent/abutting pivot cylinders (e.g., pivot cylinders 610*a* and 610*b*, and pivot cylinders 610*c* and 610*d*).

The securement strips generally hold the first and second rotating surfaces in position relative to one another, permitting the rotating surfaces to move rotationally about a pivot axis toward or away from one another but preventing non-rotational motion relative to one another. Because the securement strips are not elastic, they resist any linear force attempting to move the rotating surfaces away from one another either laterally or out-of-plane (e.g., forces placing the securement strips in tension). However, because the securement strips are pliable, they permit rotational motion of the rotating surfaces about a pivot axis defined at the abutment of the surfaces' corresponding pivot cylinders. The securement strips likewise hold opposing pivot cylinders in their abutting position while permitting the opposing pivot cylinders to revolve about the pivot axis.

Further, and as mentioned above, each securement strip is affixed to a first side of one rotating surface and an opposing side of the other rotating surface, passing between the pivot cylinders and so through the pivot axis, and so secure the rotating surfaces to one another. Thus, when the rotating surfaces are pivoted toward or away from one another, one side of the securement strip is placed in tension and the other side in compression. Further, one securement strip's tension/compression profile is opposite the other's insofar as they are attached to opposing sides of the rotating surfaces. This facilitates an even and smooth motion when pivoting the rotating surfaces towards or away from one another (e.g., when opening or closing the toy nose).

Each securement strip may include a pair of cutouts or recesses 620*a-d* defined in a portion of the strip that passes between the pivot cylinders 610*a*-610*d*. With respect to the first securement strip 615*a*, the cutouts 620*a*, 620*b* are positioned along an exterior edge of the strip while the second securement strip's 615*b* cutouts 620*c*, 620*d* are positioned along an interior edge of the strip. Generally, the cutouts 620*a*, 620*b* are sized such that each securement strip 615*a*, 615*b* can pass between pairs of pivot cylinders (e.g., cylinders 610*a* and 610*b*, and cylinders 610*c* and 601*d*) without the securement strips overlapping one another. To this end, on securement strip 615*a* passes between the pairs of pivot cylinders along an interior edge and another securement strip 615*b* passes between the pairs of pivot cylinders along an exterior edge of the cylinders. While a pivot cylinder may be described herein as abutting another pivot cylinder, it should be understood that such description encompasses embodiments where a pivot cylinder abuts a securement strip attached or adjacent to an opposing pivot cylinder.

The securement strips 615*a*, 615*b* hold the pairs of pivot cylinders 610*a*, 610*b* and 610*c*, 610*d* in alignment with one another and generally prevent the cylinders from moving laterally while allowing rotational movement. Each pivot cylinder 610*a*-610*d* is sandwiched between the securement strips 615*a*, 615*b* that extend about them, as are the associated rotating surfaces 605*a*, 605*b*. Thus, the securement strips 615*a*, 615*b* permit the rotating surfaces 605*a*, 605*b* to rotationally move towards or away from one another while prohibiting or constraining lateral movement away from one another. FIGS. 1 and 2 illustrate the securement strips 615*a*, 615*b* extending about the first pair of pivot cylinders 610*a*, 610*b* and second pair of pivot cylinders 610*c*, 610*d*.

Detents 625*a*-625*d* extend from a narrowed portion of the rotating surfaces 605*a*, 605*b*. The elastic element's ends typically loop around first and second opposing detents 625*a*, 625*b* while the elastic element's body passes over, and is held in place and tensioned by, third and fourth opposing detents 625*c*, 625*d*. As the rotating surfaces 605*a*, 605*b* move toward one another the elastic element relaxes (e.g., its internal tension is reduced) and when they move away from one another the elastic element stretches (e.g., its internal tension increases). The general effect of tension on the elastic element is discussed above. Some embodiments may use two detents for each end of the elastic element as shown in FIG. 5, while other embodiments may have an end of the elastic element wrap around a single detent as shown in FIG. 1.

When the hinge opens (e.g., as the hinged structure changes from the position shown in FIG. 1 to the position shown in FIG. 2), the rotating surfaces 605*a*, 605*b* move rotationally away from one another as the pivot cylinders 610*a*-610*d* rotate about the pivot axis 1XX. The securement strips 615*a*, 615*b* constrain motion of the rotating surfaces and pivot cylinders, forcing the rotating surfaces and pivot cylinders to rotate about the pivot axis. Likewise and as previously mentioned, the securement strips generally prevent or inhibit lateral motion of the rotating surfaces with respect to one another.

The rotation of the hinge about the pivot axis means that each of the pivot cylinders 610*a*-610*d* "roll" about an opposing pivot cylinder's surface; each pivot cylinder in a pair rotates an identical distance. The elastic element stretches as this occurs, insofar as the elastic element is looped about one or more detents that move away from one another as the hinge initially opens (e.g., the hinged structure transitions from the configuration of FIG. 1 to the configuration of FIG. 2). Generally, the elastic element seeks a position that reduces its internal tension. In other words, the elastic element seeks to contract once stretched. Thus, as the hinged structure initially opens during its transition from the configuration of FIG. 1 to that of FIG. 2, the elastic element will bias the hinged structure towards the closed configuration of FIG. 1 in the absence of any external force. Put another way, the elastic element exerts a force on the rotational surfaces (through the associated detents) that resists opening and seeks to move the rotational surfaces towards one another, back to a closed position of the hinged structure. If a user releases one of the rotational structures then that structure will rotate about the pivot axis towards the other rotational structure, traveling in a direction opposite the rotational motion experienced when the hinged structure is opened.

Once the rotating surfaces of the hinged structure move past the positions shown in FIG. 2 (e.g., once rotation of the pivot cylinders and rotating surfaces carries the rotating surfaces past the position of FIG. 2), in the absence of an external force the elastic element will transition the hinged structure to the fully-open position of FIG. 5 in order to reduce its internal tension. Thus, the elastic element will always bias the rotating surfaces to rotate the shortest distance necessary to have those surfaces contact one another, or come as close to one another as possible in the event a stop or offset prevents the surfaces from contacting one another. The pairs of pivot cylinders facilitate the rotational motion of the rotating surfaces and the securement strips align and retain the rotating surfaces with respect to one another.

As the hinged structure moves from the fully-closed position of FIG. 1 to the fully-open position of FIG. 5, the honeycomb material expands to form a sphere or a portion of a sphere. The size, pattern, and density of the honeycomb material may vary between embodiments.

Although the hinged structure has been generally discussed in the context of a toy such as a toy nose, it should be appreciated that the hinged structure may be used in many different devices, items, and contexts. For example, a hinged structure may form the spine (or part of the spine) of a book. A hinged structure may function as a door hinge, as part of a wallet, be incorporated into a fan, and so on. Devices or items may use a single hinged structure or multiple hinged structures to facilitate rotational opening and closing of the device or item. The pivot surfaces may be replaced by a flexure or other structure in certain embodiments. In some embodiments, the rotating surfaces may not be semicircular as illustrated but instead may be parallelepipeds, triangular, or other polyhedral shapes, or irregular shapes. Embodiments may utilize the pivot cylinder structure without the elastic element or the elastic element without the pivot cylinder structure (as, for example, where the pivot cylinders are replaced by a flexure or living hinge). Other variations beyond those listed herein are possible.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A toy, comprising:

an expandable body defining a honeycomb shape;

a first rotating surface attached to a first portion of the expandable body;

a second rotating surface attached to a second portion of the expandable body, the expandable body configured to expand as the first and second rotating surfaces separate;

a first detent attached to the first rotating surface;

a second detent attached to the second rotating surface;

a bistable hinge, comprising:

an elastic element attached to the first rotating surface and the second rotating surface; and a pivot structure attached to the first and second rotating surfaces; wherein:

as the first and second rotating surfaces rotate, a tension in the elastic element changes.

2. The toy of claim 1, further comprising a securement strip affixing the first rotating surface to the second rotating surface.

3. The toy of claim 2, wherein:

the securement strip is a first securement strip; and a second securement strip further affixes the first rotating surface to the second rotating surface.

4. The toy of claim 2, wherein the securement strip is affixed to a first surface of the first rotating surface and affixed to a second, opposing surface of the second rotating surface.

5. The toy of claim 1, wherein:

the tension in the elastic element increases as the first and second rotating surfaces move further from one another; and the tension in the elastic element decreases as the first and second rotating surfaces move towards one another.

* * * * *